US009744090B2

(12) United States Patent
Wray

(10) Patent No.: US 9,744,090 B2
(45) Date of Patent: Aug. 29, 2017

(54) DECORATIVE HARDWARE FOR STATIONARY BAR CASKETS

(71) Applicant: Batesville Services, Inc., Batesville, IN (US)

(72) Inventor: Gregory W. Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 14/710,085

(22) Filed: May 12, 2015

(65) Prior Publication Data

US 2015/0328076 A1 Nov. 19, 2015

Related U.S. Application Data

(60) Provisional application No. 61/992,591, filed on May 13, 2014.

(51) Int. Cl.

| | |
|---|---|
| ***A61G 17/04*** | (2006.01) |
| ***A61G 17/007*** | (2006.01) |
| ***A61G 17/02*** | (2006.01) |

(52) U.S. Cl.

CPC ..... *A61G 17/04* (2013.01); *A61G 17/0076* (2013.01); *A61G 17/02* (2013.01); *A61G 17/041* (2016.11); *A61G 17/042* (2016.11)

(58) Field of Classification Search

CPC ..... A61G 17/0076; A61G 17/04; A61G 2017/041; A61G 2017/042; A61G 17/041; A61G 17/042; A61G 17/02; Y10T 16/4701; A47B 95/02; E05F 2013/063

USPC ..... 27/2, 6, 10, 19, 27; 16/424; 52/287.1

See application file for complete search history.

(56) References Cited

U.S. PATENT DOCUMENTS

| | | | | |
|---|---|---|---|---|
| 2,106,695 | A * | 1/1938 | Larson | A61G 17/04 27/10 |
| 2,330,141 | A | 9/1943 | Olson | |
| 3,204,286 | A | 9/1965 | Hillenbrand | |
| 4,615,085 | A | 10/1986 | Hartman | |
| 5,144,727 | A | 9/1992 | Craft | |
| 5,241,729 | A | 9/1993 | MacKirdy | |
| 5,335,402 | A | 8/1994 | Semon | |
| 5,604,965 | A | 2/1997 | Shaw et al. | |
| 5,898,980 | A | 5/1999 | Havranek et al. | |

(Continued)

OTHER PUBLICATIONS

Gregory Wray, U.S. Appl. No. 14/656,069, filed Mar. 12, 2015 entitled Casket Corner Attachment Mechanism.

(Continued)

*Primary Examiner* — William Miller

(74) *Attorney, Agent, or Firm* — Wood Herron & Evans LLP

(57) ABSTRACT

A casket comprises a casket shell adapted to receive a deceased, a casket lid closeable on the shell, a handling bar non-pivotally attached to the shell with a first attachment mechanism, a decorative cover overlying the first attachment mechanism and operably attached to the shell with a second attachment mechanism, the second attachment mechanism having a first portion mounted to the shell and a second portion mounted to the decorative cover, the first and second portions of the second attachment mechanism resiliently cooperating to operably removably attach the decorative cover to the casket shell.

54 Claims, 8 Drawing Sheets

(56) References Cited

U.S. PATENT DOCUMENTS

| | | | | |
|---|---|---|---|---|
| 8,256,727 | B2 * | 9/2012 | Hiester | A61G 17/04 248/213.2 |
| 2015/0107068 | A1 | 4/2015 | Drew et al. | |
| 2015/0257961 | A1 * | 9/2015 | Wray | A61G 17/04 27/10 |

OTHER PUBLICATIONS

Travis Drew et al., U.S. Appl. No. 14/453,132, filed Aug. 6, 2014 entitled Casket Hardware Attachment Structure.

* cited by examiner

DECORATIVE HARDWARE FOR STATIONARY BAR CASKETS

RELATED APPLICATIONS

This application claims the priority benefit of U.S. Provisional Patent Application No. 61/992,591 filed May 13, 2014, which is hereby incorporated by reference herein as if fully set forth in its entirety.

FIELD OF THE INVENTION

This invention relates generally to caskets, and more particularly to decorative hardware for caskets.

BACKGROUND OF THE INVENTION

Caskets are generally of the pivoting bar variety or the stationary bar variety. In pivoting bar type caskets, the elongated handling bars are mounted to the side walls and end walls of the casket shell via "swing arms." One end of the swing arm is pivotally mounted to the shell wall and to the other end of the swing arm the handling bar is fixedly mounted. The pivotal connection of the swing arm to the shell wall is designed such that for display the handling bar lies adjacent the shell wall, and for use, i.e. transporting the casket, the handling bar pivots upwardly and outwardly so as to be easily grasped by the hand.

Stationary bar or "non-swing arm" caskets have their handling bars fixedly mounted to the shell walls. The fixed spacing from the shell walls is such that the handling bar can be easily grasped by the hand.

For both types of caskets, decorative covering hardware or a plate, sometimes called an "escutcheon" or "ear", disguises the connection point of either the swing arm or the handling bar to the shell wall. For stationary bar caskets, the decorative covers can have a pair of holes, one in each side of the cover, which requires the decorative cover to be "threaded onto" the stationary bar by passing the bar through the holes in the cover. While traditionally fabricated of such metals as steel, stainless steel, bronze, etc., decorative covers may now be fabricated of, for example, plastic. Nevertheless, as used herein, the term "hardware" shall embrace all decorative plates/covers/escutcheons/ears, whether fabricated from metallic material or nonmetallic material.

It would be desirable to provide decorative hardware for stationary bar caskets that eliminates the need to "thread" the decorative cover onto the stationary bar.

SUMMARY OF THE INVENTION

In one aspect, a casket comprises a casket shell adapted to receive a deceased, a casket lid closeable on the shell, a handling bar non-pivotally attached to the shell with a first attachment mechanism, a decorative cover overlying the first attachment mechanism and operably attached to the shell with a second attachment mechanism, the second attachment mechanism having a first portion mounted to the shell and a second portion mounted to the decorative cover, the first and second portions of the second attachment mechanism resiliently cooperating to operably removably attach the decorative cover to the casket shell.

The decorative cover can be slotted on opposite sides thereof such that an upper portion of the decorative cover is positioned above the handling bar and a lower portion of the decorative cover is positioned below the handling bar, and such that an inward most edge of the decorative cover is positioned inwardly of an inward most edge of the handling bar.

The first attachment mechanism can comprise a rail with an outwardly extending C-shaped bracket thereon, the rail mounted to the casket shell, the C-shaped bracket slidingly accepting the handling bar, the handling bar having a cross-section that mates with the C-shaped bracket such that the handling bar does not rotate in the bracket. The second attachment mechanism first portion can comprise a pair of legs attached to at least one wall of the casket shell, a pair of generally vertically oriented side walls each of which is associated with a respective one of the legs, each side wall including a generally vertically oriented rib thereon. The second attachment mechanism second portion can comprise a pair of generally vertically oriented side walls each of which includes a generally vertically oriented slot therein. The pair of second attachment mechanism second portion side walls resiliently cooperates with the pair of second attachment mechanism first portion side walls such that the ribs are received in the slots.

The second attachment mechanism first portion can include a pair of vertically spaced apart vertical locators preventing vertical movement of the second attachment mechanism second portion beyond a predetermined amount. The second attachment mechanism first portion can also include a horizontal locator horizontally spaced apart from one of the side walls of the second attachment mechanism first portion, the horizontal locator and the one side wall preventing horizontal movement of the second attachment mechanism second portion beyond a predetermined amount. In a preferred embodiment, each side wall of the second attachment mechanism first portion includes a pair of the vertically spaced apart vertical locators, and each side wall of the second attachment mechanism first portion includes a pair of vertically spaced apart horizontal locators. Each upper edge and lower edge of each side wall of the second attachment mechanism second portion can include a notch therein receiving a respective one of the vertically spaced apart vertical locators.

The side walls of the second attachment mechanism first portion can be connected with a front wall. The side walls of the second attachment mechanism second portion can be cantilevered from a front wall of the decorative cover, and each of the side walls of the second attachment mechanism second portion can further be connected to the front wall of the decorative cover with a pair of vertically spaced apart gussets. In a preferred embodiment, the upper gusset of each pair of gussets can be positioned above an upper end of a respective one of the generally vertically oriented slots and a lower gusset of each pair of gussets can be positioned below a lower end of a respective one of the generally vertically oriented slots.

The first and second portions of the second attachment mechanism can be preferably molded from plastic. Further, the decorative cover and second attachment mechanism second portion can be integrally molded from plastic. The legs of the second attachment mechanism first portion can be fastened to the casket shell walls with plastic Christmas tree fasteners. The casket can be fabricated from either wood or metal. The first and second attachment mechanisms can be integrally formed as one.

In another aspect, a casket comprises a casket shell adapted to receive a deceased, a casket lid closeable on the shell, a first handling bar non-pivotally attached to a side wall of the shell and a second handling bar non-pivotally attached to an end wall of the shell, and a decorative cover overlying adjacent ends of the first and second handling bars, the decorative cover being slotted on opposite lateral sides thereof from an inward edge outwardly such that an upper portion of the decorative cover is positioned above and inward of the ends of the handling bars and a lower portion of the decorative cover is positioned below and inward of the ends of the handling bars.

The casket can further comprise a support mounted to the shell for supporting the adjacent ends of the handling bars, and an attachment mechanism having a first portion mounted to one of the shell and the support and a second portion mounted to the decorative cover for attaching the decorative cover to the casket shell. The support can comprise a right angle rail having a pair of legs with an outwardly extending C-shaped bracket on each leg, the rail mounted to the casket shell, each C-shaped bracket slidingly accepting a respective end of a respective one of the handling bars, each handling bar having a cross-section that generally mates with the C-shaped bracket such that the handling bars do not rotate in the brackets.

The first and second portions of the attachment mechanism can be configured to resiliently cooperate to attach the decorative cover to the casket shell. The attachment mechanism first portion can comprise a pair of legs, a pair of generally vertically oriented side walls each of which is associated with a respective one of the legs, each side wall including a generally vertically oriented rib thereon. The attachment mechanism second portion can comprise a pair of generally vertically oriented side walls each of which includes a generally vertically oriented slot therein. The pair of attachment mechanism second portion side walls can resiliently cooperate with the pair of attachment mechanism first portion side walls such that the ribs are received in the slots.

The attachment mechanism first portion can include a pair of vertically spaced apart vertical locators preventing vertical movement of the attachment mechanism second portion beyond a predetermined amount. The attachment mechanism first portion can include a horizontal locator horizontally spaced apart from one of the side walls of attachment mechanism first portion, the horizontal locator and the one side wall preventing horizontal movement of the attachment mechanism second portion beyond a predetermined amount. Each side wall of the attachment mechanism first portion can include a pair of the vertically spaced apart vertical locators. Each side wall of the attachment mechanism first portion can include a pair of the vertically spaced apart horizontal locators. Each of an upper edge and a lower edge of each side wall of the attachment mechanism second portion can include a notch therein receiving a respective one of the vertically spaced apart vertical locators. The side walls of the attachment mechanism first portion can be connected with a front wall. The side walls of the attachment mechanism second portion can be cantilevered from a front wall of the decorative cover, and each of the side walls of the attachment mechanism second portion can be further connected to the front wall of the decorative cover with a pair of vertically spaced apart gussets. An upper gusset of each pair of gussets can be positioned above an upper end of a respective one of the generally vertically oriented slots and a lower gusset of each pair of gussets can be positioned below a lower end of a respective one of the generally vertically oriented slots.

The first and second portions of the attachment mechanism can be molded from plastic. The decorative cover and the attachment mechanism second portion can be integrally molded from plastic. The legs of the attachment mechanism first portion can be fastened to the casket shell wall with plastic Christmas tree fasteners. The casket can be fabricated of wood or sheet metal.

In another aspect, a casket comprises a casket shell adapted to receive a deceased, a casket lid closeable on the shell, a handling bar non-pivotally attached to the shell, and a decorative cover overlying the handling bar, the decorative cover being slotted on opposite lateral sides thereof from an inward edge outwardly such that an upper portion of the decorative cover is positioned above and inward of the handling bar and a lower portion of the decorative cover is positioned below and inward of the handling bar.

The decorative cover can be either a shell side wall decorative cover, a shell end wall decorative cover, or a shell corner decorative cover.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
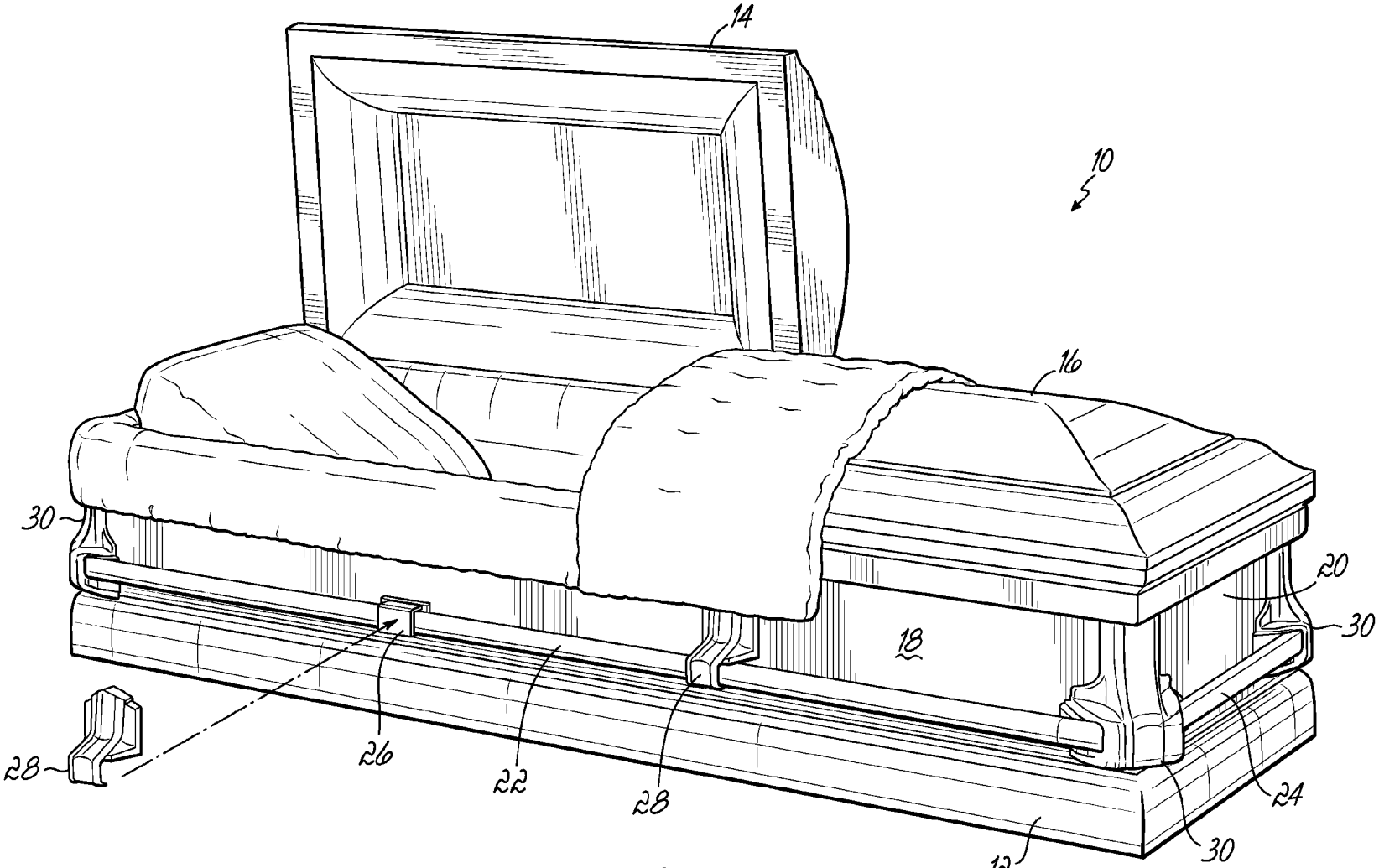
FIG. 1 is a perspective view of a stationary bar casket and decorative hardware according to the principles of the present invention.

Referring first to FIG. 1, there is illustrated a casket 10 according to the principles of the present invention. Casket 10 includes a shell 12 and one or more caps or lids 14, 16 closeable on the shell 12. The shell 12 includes a pair of side walls 18 and a pair of end walls 20. Each side wall 18 includes a handling bar 22 non-pivotally mounted thereto and each end wall 20 includes a handling bar 24 non-pivotally mounted thereto. Each handling bar 22 is mounted intermediate its ends to the shell side wall 18 with a pair of brackets 26, 26 each of which is covered with a decorative ear or escutcheon 28. The ends of the handling bars 22, 24 are mounted to the shell 12 in a manner discussed below. And, the adjacent ends of handling bars 22, 24 are covered with a decorative cover 30, attached in a manner discussed below.

Figure 2A:
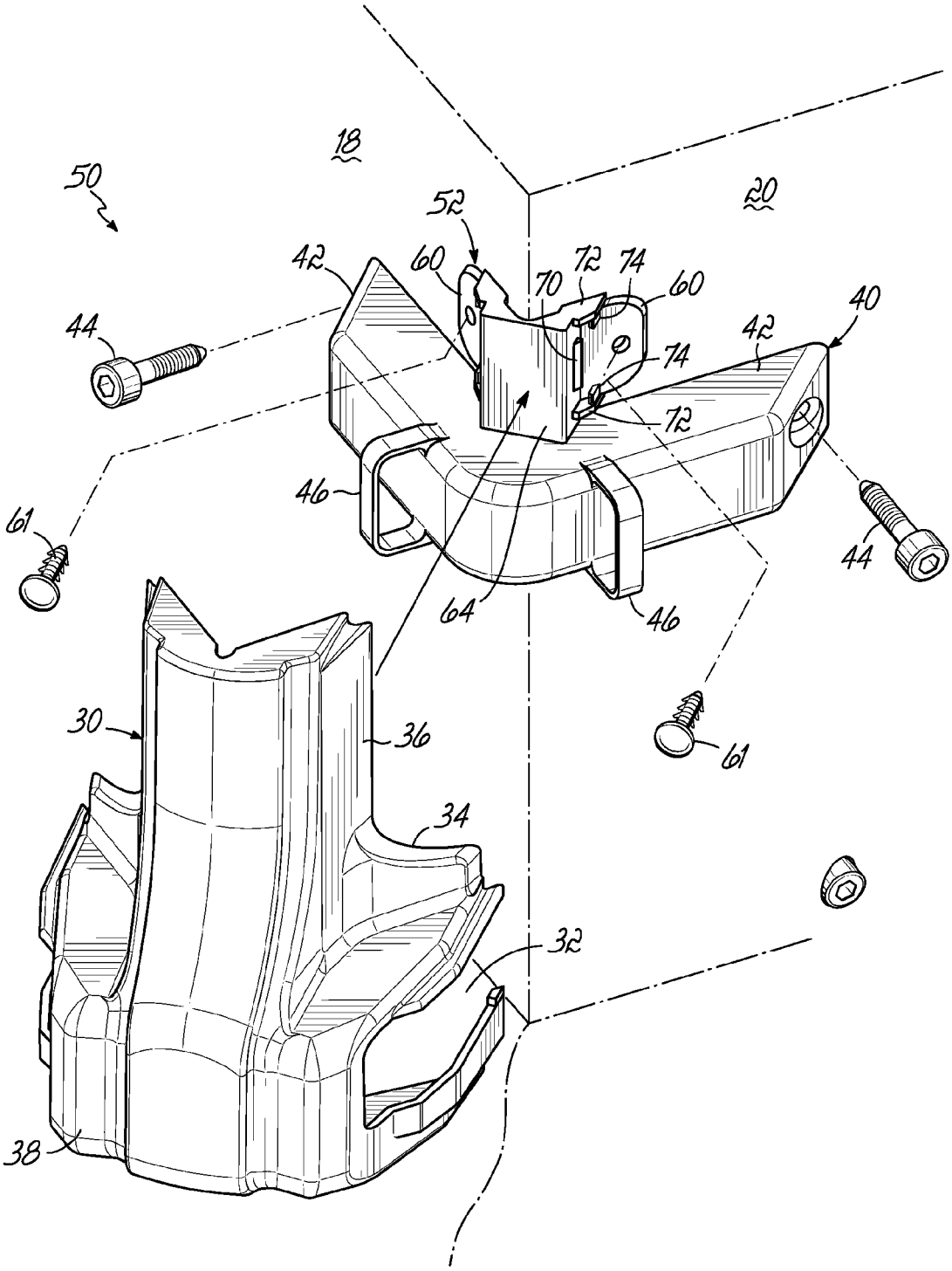
FIG. 2A is an enlarged, disassembled, front perspective view of one corner of the casket shell of FIG. 1 illustrating the stationary bar attachment structure and the decorative cover attachment structure.
Figure 2B:
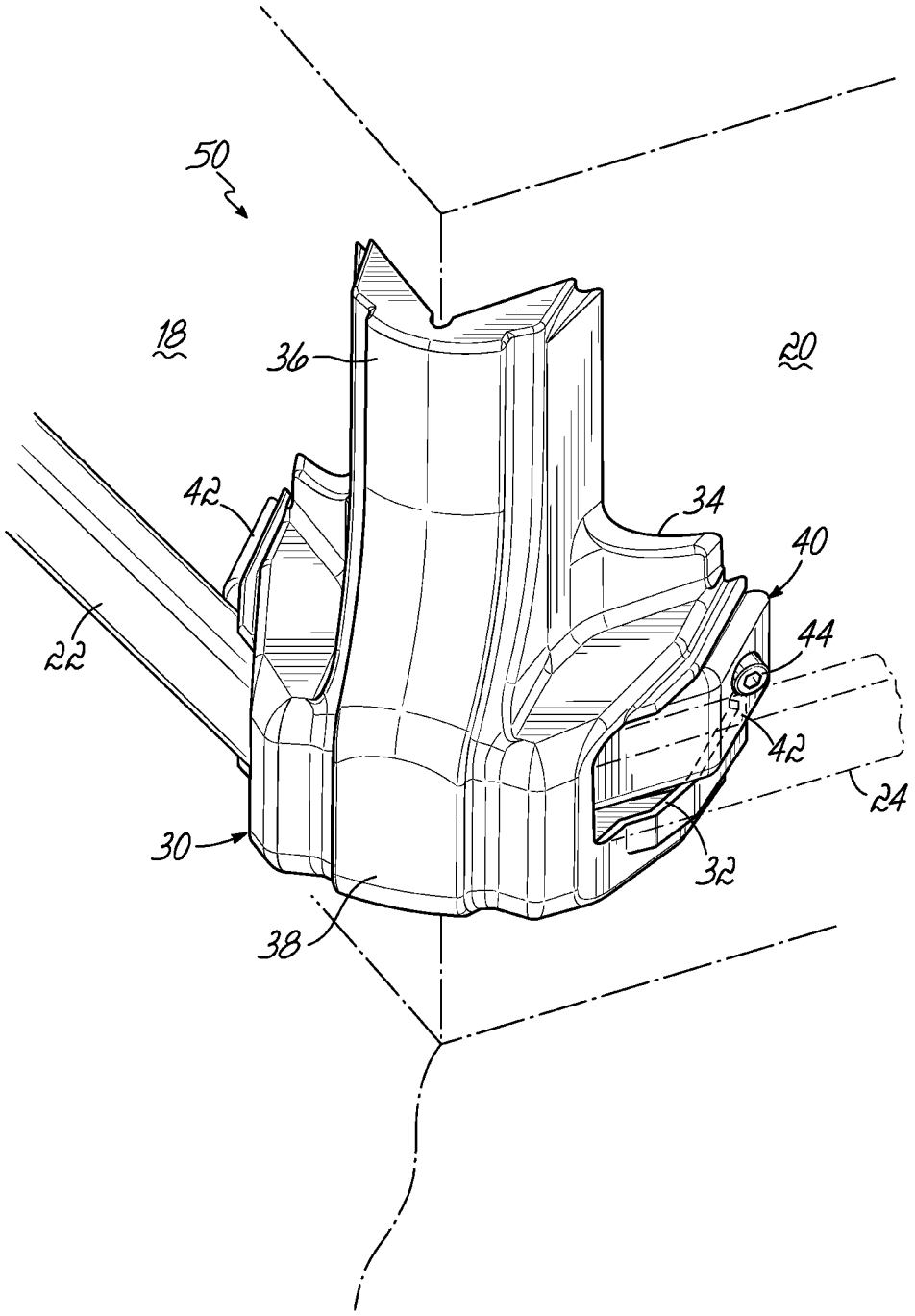
FIG. 2B is a view similar to FIG. 2A but in an assembled state.
Figure 3A:
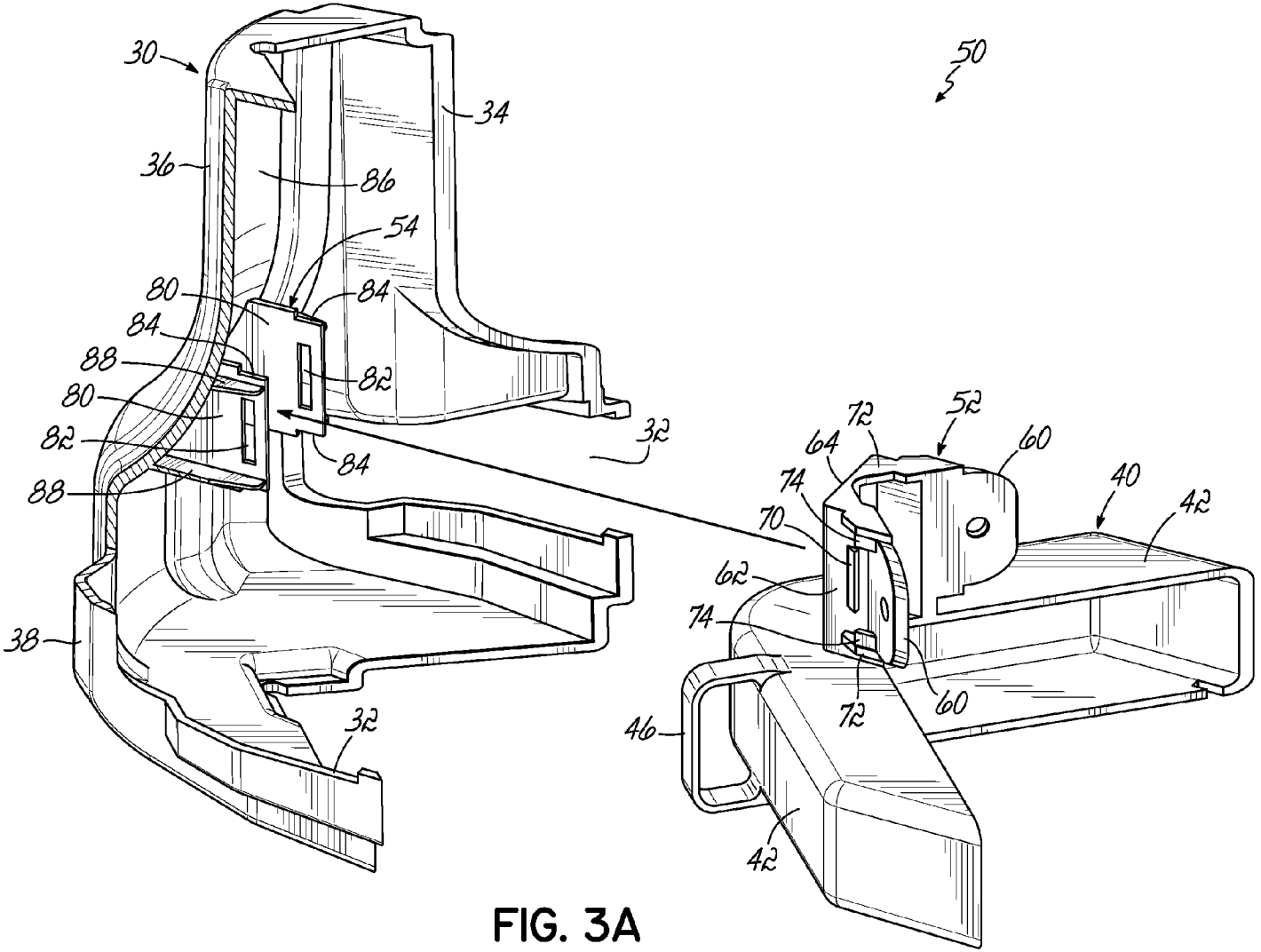
FIG. 3A is an enlarged, disassembled, side perspective view of the corner of the casket shell of FIG. 2A illustrating the stationary bar attachment structure and the decorative cover attachment structure.
Figure 3B:
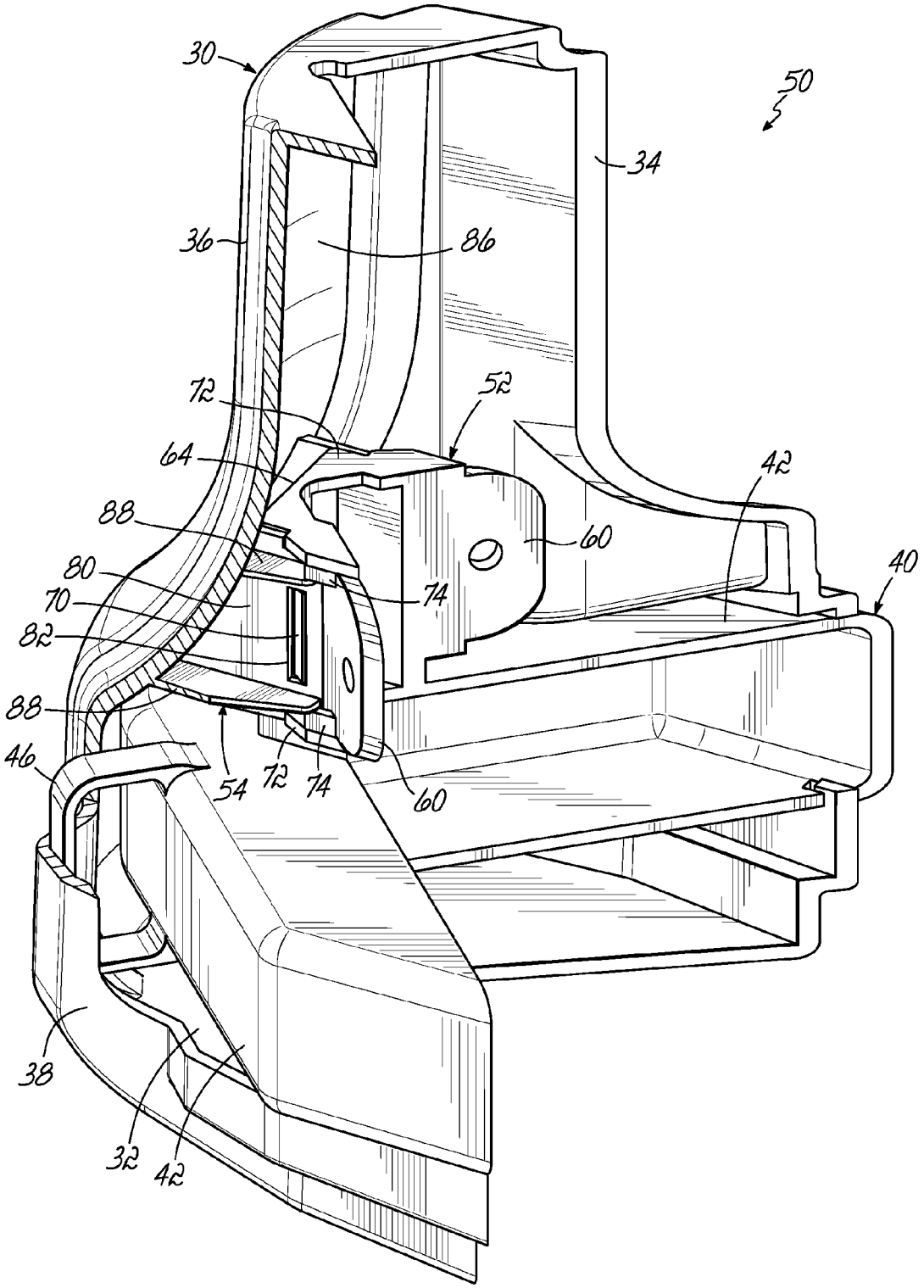
FIG. 3B is a view similar to FIG. 3A but in partial cross-section and in an assembled state.
Figure 4A:
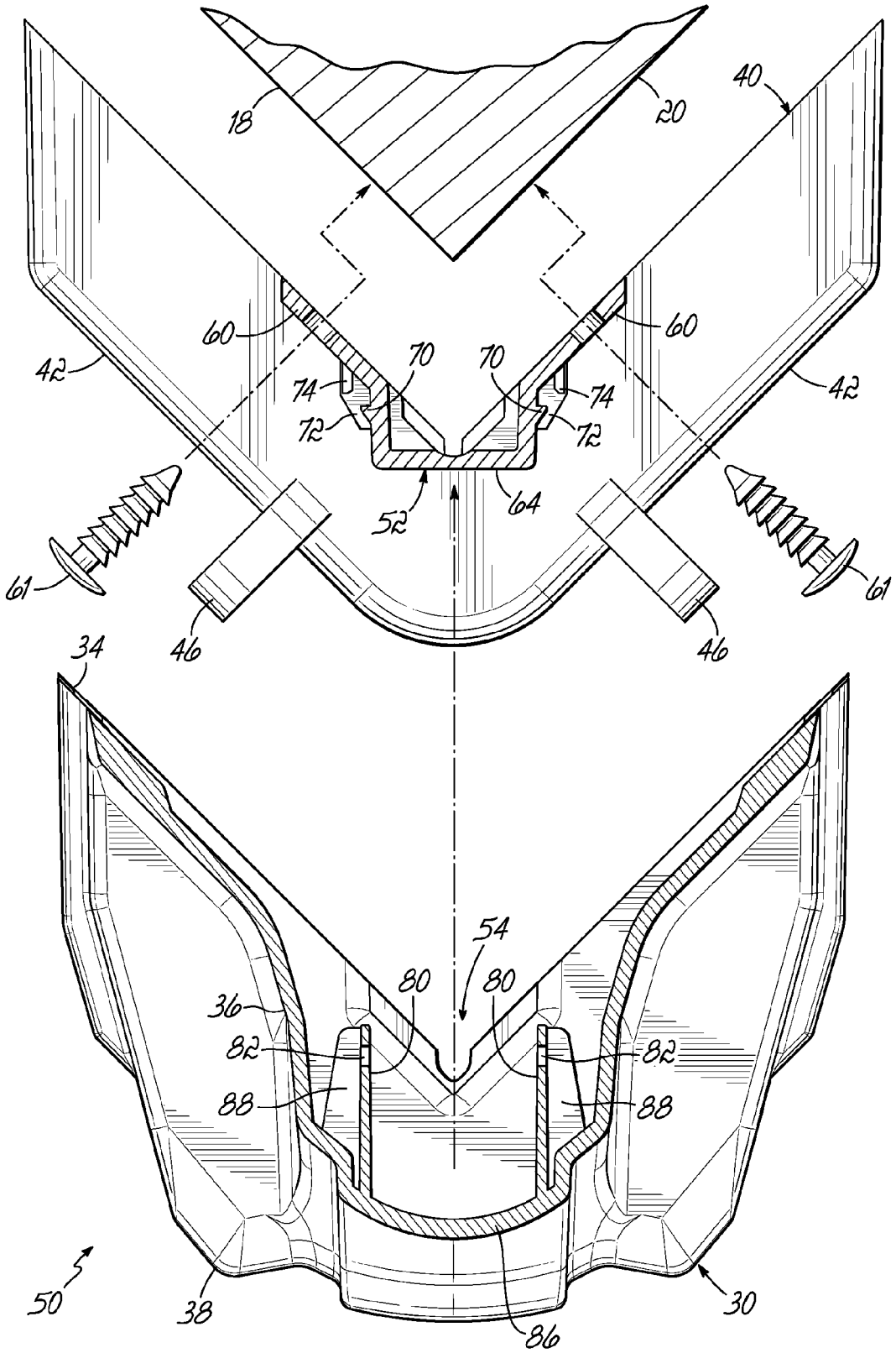
FIG. 4A is an enlarged, disassembled, top view of the corner of the casket shell of FIG. 2A in partial cross-section illustrating the stationary bar attachment structure and the decorative cover attachment structure.
Figure 4B:
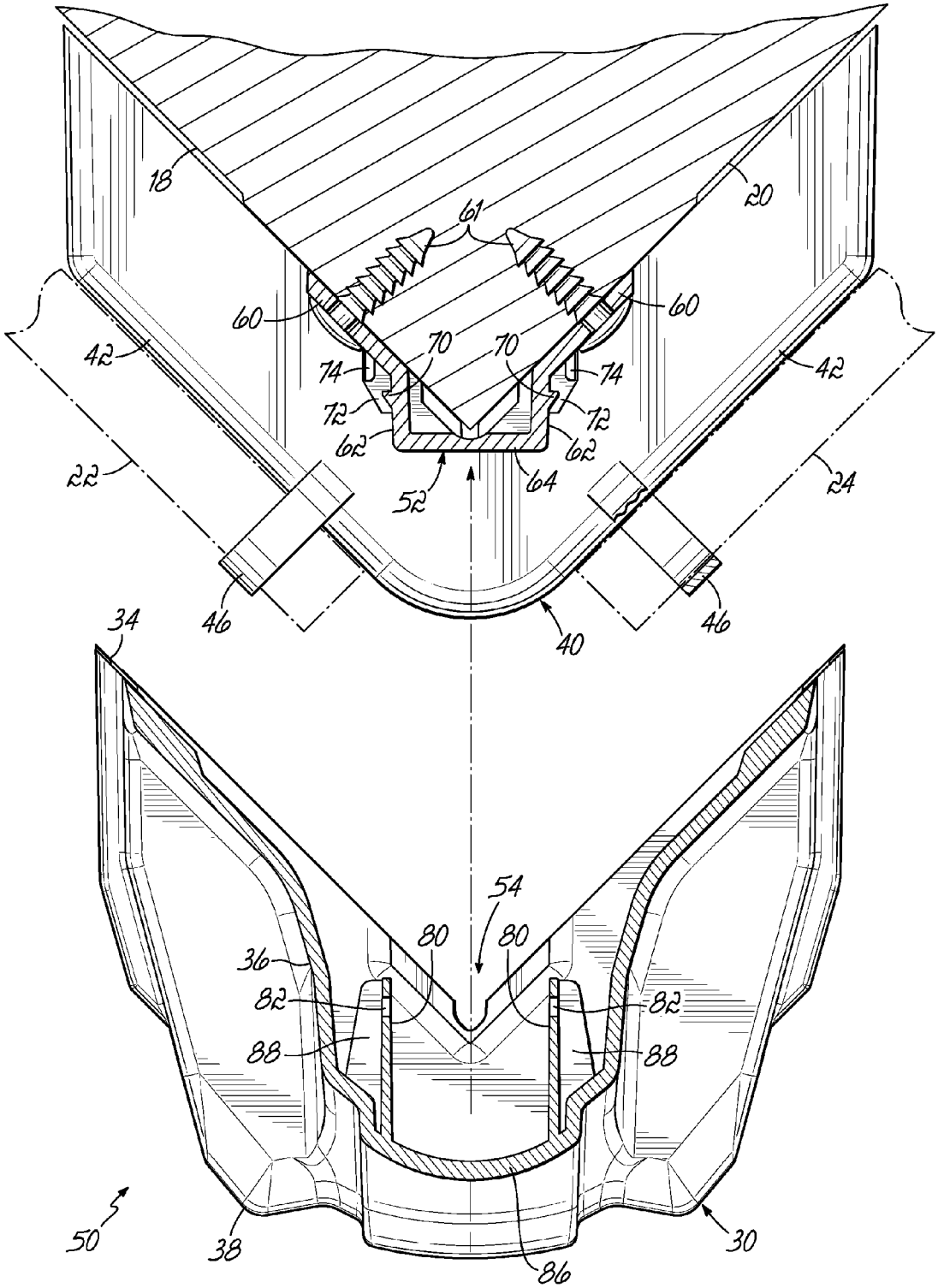
FIG. 4B is a view similar to FIG. 4A but in a partially assembled state.
Figure 4C:
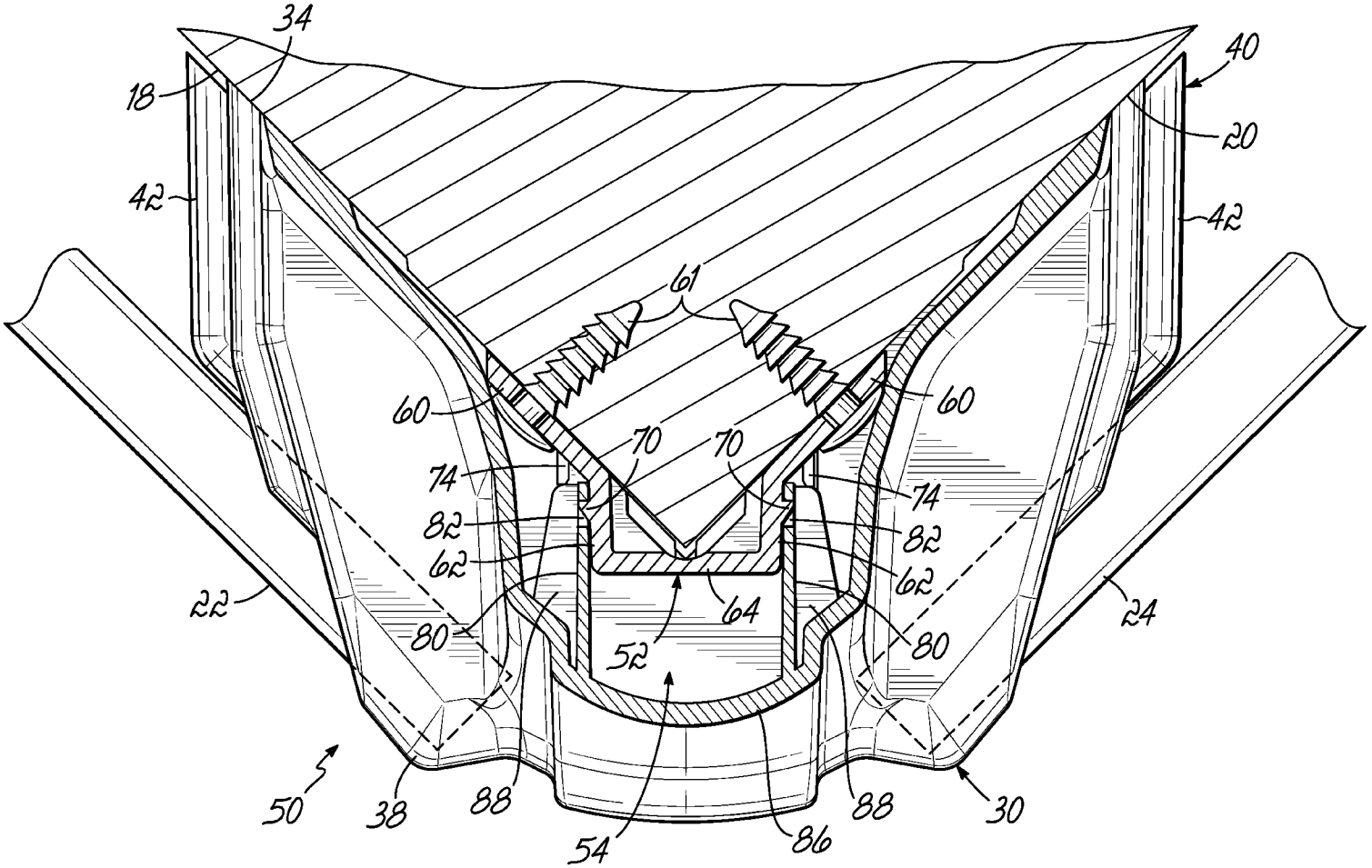
FIG. 4C is a view similar to FIG. 4B but in a fully assembled state.

Referring to FIGS. 2A and 2B, decorative cover 30 has a slot 32 on each lateral side of the cover 30 that extends outwardly from an inward edge 34, defining an upper portion 36 that is positioned above and inward of the ends of the handling bars 22, 24 and a lower portion 38 that is positioned below and inward of the ends of the handling bars 22, 24.

A support 40 in the form of a right angle rail has a pair of legs 42, 42 each of which are bolted or screwed or welded to a respective one of the shell side walls 18 and end walls 20 with a bolt or screw 44. Each leg 42 has an outwardly extending C-shaped bracket 46 which slidingly accepts a respective end of a respective one of the handling bars 22, 24. The handling bars 22, 24 each have a cross-section that generally mates with the C-shaped brackets 46 such that the handling bars 22, 24 do not rotate in the brackets 46.

Referring to FIGS. 2A-4C, an attachment mechanism 50 for attaching the decorative cover 30 to the shell 12 is illustrated in more detail. The attachment mechanism 50 has a first portion 52 mounted to a corner of the shell 12 and a second portion 54 mounted to the decorative cover 30. More particularly, the first portion 52 can take the form of a pair of legs 60 oriented at about a 90 degree angle relative to one another, a pair of generally vertically oriented side walls 62, each side wall 62 oriented at about a 135 degree angle relative to its respective leg 60, and a front wall 64. Legs 60 can be fastened to the casket shell 12 side 18 and end 20 walls with plastic Christmas tree fasteners 61, for example. Other fasteners or fastening techniques can also be used such as bolts, screws, welding, etc. Each side wall 62 has a generally vertically oriented rib 70 thereon. The first attachment mechanism portion 52 further includes two pairs of vertically spaced apart vertical locators 72, each pair associated with each respective leg 60 and side wall 62, preventing vertical movement of the attachment mechanism second portion 54 beyond a predetermined amount, and two pairs of vertically spaced apart horizontal locators 74, each pair also associated with each respective leg 60 and side wall 62, preventing horizontal movement of the attachment mechanism second portion 54 beyond a predetermined amount.

The second attachment mechanism portion 54 can take the form of a pair of generally vertically oriented side walls 80 each of which includes a generally vertically oriented slot 82 therein. The pair of attachment mechanism second portion 54 side walls 80 resiliently cooperate with the pair of attachment mechanism first portion 52 side walls 62 such that the ribs 70 are resiliently received in the slots 82. Each of an upper edge and a lower edge of each side wall 80 of the attachment mechanism second portion 54 includes a notch 84 therein receiving a respective one of the vertical locators 72 of the attachment mechanism first portion 52. The forward upper and lower portions of each side wall 80 of the attachment mechanism second portion 54 are received between the horizontal locators 74 and their respective side wall 62 of the attachment mechanism first portion 52. The side walls 80 of attachment mechanism second portion 54 are cantilevered from a front wall 86 of the decorative cover 30, and are further connected to the front wall 86 of the decorative cover 30 with a pair of vertically spaced apart gussets 88. An upper gusset 88 of each pair of gussets 88 is positioned above an upper end of a respective one of the generally vertically oriented slots 82 and a lower gusset 88 of each pair of gussets 88 is positioned below a lower end of a respective one of the generally vertically oriented slots 82.

To enable resilient connection between the first 52 and second 54 portions of the attachment mechanism 50, the first 52 and second 54 portions of the attachment mechanism 50 can be fabricated of plastic, for example molded from plastic. Other resilient materials having a degree of flexibility could also be used, for example stamped sheet metal such as carbon steel, stainless steel, bronze, copper, etc. To simplify the manufacturing process, the decorative cover 30 and the attachment mechanism second portion 54 could be integrally molded from plastic, and the support 40 and attachment mechanism first portion 52 could be integrally molded from plastic. Alternatively, the decorative cover 30 and the attachment mechanism second portion 54 could be integrally stamped from sheet metal, and the support 40 and attachment mechanism first portion 52 could be integrally stamped from sheet metal, for example sheet metal such as carbon steel, stainless steel, bronze, copper, etc. Alternatively, the support 40 and attachment mechanism first portion 52 could be separately fabricated, with the support 40 being fabricated of metal for structural strength and stiffness in supporting the ends of the handling bars 22, 24, and the attachment mechanism first portion 52 being molded from plastic to resiliently cooperate with the attachment mechanism first portion 52 also molded from plastic or being stamped from sheet metal to resiliently cooperate with the attachment mechanism first portion 52 also stamped from sheet metal. The decorative cover 30 and attachment mechanism 50 could be used on either wood caskets or sheet metal caskets.

To attach the decorative cover 30 to the casket shell 12, the first 52 and second 54 portions of the attachment mechanism 52 are aligned and the decorative cover 30 and first portion 52 are pressed forwardly onto second portion 54 causing ribs 70 to snap into slots 82. To remove the decorative cover 30 from the casket shell 12, the side walls 80 of second portion 54 are deflected slightly outwardly, which may require a tool, for example screw driver, causing ribs 70 to withdraw from slots 82.

Advantageously, the decorative cover and decorative cover attachment mechanism of the present invention can be utilized to mount decorative covers to the shell side walls, to the shell end walls, and to the shell corners.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A casket comprising:

a casket shell adapted to receive a deceased, a casket lid closeable on said shell, a handling bar non-pivotally attached to said shell with a first attachment mechanism, a decorative cover overlying said first attachment mechanism and operably attached to said shell with a second attachment mechanism, said second attachment mechanism having a first portion mounted to said shell and a second portion mounted to said decorative cover, said first and second portions of said second attachment mechanism resiliently cooperating to operably removably attach said decorative cover to said casket shell, one of said first and second portions of said second attachment mechanism being a pair of ribs and the other of said first and second portions of said second attachment mechanism being a pair of slots, each said rib being resiliently received in a respective one of said slots.

2. The casket of claim 1 wherein said casket is fabricated of wood.

3. The casket of claim 1 wherein said casket is fabricated of sheet metal.

4. A casket comprising:

a casket shell adapted to receive a deceased, a casket lid closeable on said shell, a handling bar non-pivotally attached to said shell with a first attachment mechanism, a decorative cover overlying said first attachment mechanism and operably attached to said shell with a second attachment mechanism, said second attachment mechanism having a first portion mounted to said shell and a second portion mounted to said decorative cover, said first and second portions of said second attachment mechanism resiliently cooperating to operably removably attach said decorative cover to said casket shell, wherein said decorative cover is slotted on opposite sides thereof such that an upper portion of said decorative cover is positioned above said handling bar and a lower portion of said decorative cover is positioned below said handling bar, and such that an inward most edge of said decorative cover is positioned inwardly of an inward most edge of said handling bar.

5. A casket comprising:

a casket shell adapted to receive a deceased, a casket lid closeable on said shell, a handling bar non-pivotally attached to said shell with a first attachment mechanism, a decorative cover overlying said first attachment mechanism and operably attached to said shell with a second attachment mechanism, said second attachment mechanism having a first portion mounted to said shell and a second portion mounted to said decorative cover, said first and second portions of said second attachment mechanism resiliently cooperating to operably removably attach said decorative cover to said casket shell, wherein said first attachment mechanism comprises a rail with an outwardly extending C-shaped bracket thereon, said rail mounted to said casket shell, said C-shaped bracket slidingly accepting said handling bar, said handling bar having a cross-section that mates with said C-shaped bracket such that said handling bar does not rotate in said bracket.

6. A casket comprising:

a casket shell adapted to receive a deceased, a casket lid closeable on said shell, a handling bar non-pivotally attached to said shell with a first attachment mechanism, a decorative cover overlying said first attachment mechanism and operably attached to said shell with a second attachment mechanism, said second attachment mechanism having a first portion mounted to said shell and a second portion mounted to said decorative cover, said first and second portions of said second attachment mechanism resiliently cooperating to operably removably attach said decorative cover to said casket shell, wherein said second attachment mechanism first portion comprises:

a pair of legs attached to at least one wall of said casket shell, a pair of generally vertically oriented side walls each of which is associated with a respective one of said legs, each said side wall including a generally vertically oriented rib thereon, wherein said second attachment mechanism second portion comprises:

a pair of generally vertically oriented side walls each of which includes a generally vertically oriented slot therein;

said pair of second attachment mechanism second portion side walls resiliently cooperating with said pair of second attachment mechanism first portion side walls such that said ribs are received in said slots.

7. The casket of claim 6 wherein said second attachment mechanism first portion includes a pair of vertically spaced apart vertical locators preventing vertical movement of said second attachment mechanism second portion beyond a predetermined amount.

8. The casket of claim 7 wherein each said side wall of said second attachment mechanism first portion includes said pair of vertically spaced apart vertical locators.

9. The casket of claim 8 wherein each of an upper edge and a lower edge of each said side wall of said second attachment mechanism second portion includes a notch therein receiving a respective one of said vertically spaced apart vertical locators.

10. The casket of claim 6 wherein said second attachment mechanism first portion includes at least one horizontal locator horizontally spaced apart from one of said side walls of said second attachment mechanism first portion, said at least one horizontal locator and said one side wall preventing horizontal movement of said second attachment mechanism second portion beyond a predetermined amount.

11. The casket of claim 10 wherein each said side wall of said second attachment mechanism first portion includes a pair of vertically spaced apart horizontal locators.

12. The casket of claim 6 wherein said side walls of said second attachment mechanism first portion are connected with a front wall.

13. The casket of claim 6 wherein said side walls of said second attachment mechanism second portion are cantilevered from a front wall of said decorative cover, and wherein each of said side walls of said second attachment mechanism second portion are further connected to said front wall of said decorative cover with a pair of vertically spaced apart gussets.

14. The casket of claim 13 wherein an upper gusset of each said pair of gussets is positioned above an upper end of a respective one of said generally vertically oriented slots and a lower gusset of each said pair of gussets is positioned below a lower end of a respective one of said generally vertically oriented slots.

15. The casket of claim 6 wherein said first and second portions of said second attachment mechanism are molded from plastic.

16. The casket of claim 15 wherein said decorative cover and said second attachment mechanism second portion are integrally molded from plastic.

17. The casket of claim 6 wherein said legs of said second attachment mechanism first portion are fastened to said casket shell wall with plastic Christmas tree fasteners.

18. A casket comprising:

a casket shell adapted to receive a deceased, a casket lid closeable on said shell, a handling bar non-pivotally attached to said shell with a first attachment mechanism, a decorative cover overlying said first attachment mechanism and operably attached to said shell with a second attachment mechanism, said second attachment mechanism having a first portion mounted to said shell and a second portion mounted to said decorative cover, said first and second portions of said second attachment mechanism resiliently cooperating to operably removably attach said decorative cover to said casket shell, wherein said first attachment mechanism and said first portion of said second attachment mechanism are integrally formed as one.

19. A casket comprising:

a casket shell adapted to receive a deceased, a casket lid closeable on said shell, a first handling bar non-pivotally attached to a side wall of said shell and a second handling bar non-pivotally attached to an end wall of said shell, and a decorative cover overlying adjacent ends of said first and second handling bars, said decorative cover being slotted on opposite lateral sides thereof from an inward edge outwardly such that an upper portion of said decorative cover is positioned above and inward of said ends of said handling bars and a lower portion of said decorative cover is positioned below and inward of said ends of said handling bars, one of said casket shell and decorative cover having a pair of ribs and the other of said casket shell and decorative cover having a pair of slots, each said rib being resiliently received in a respective one of said slots.

20. The casket of claim 19 further comprising:

a support mounted to said shell for supporting said adjacent ends of said handling bars.

21. The casket of claim 19 wherein said casket is fabricated of wood.

22. The casket of claim 19 wherein said casket is fabricated of sheet metal.

23. A casket comprising:

a casket shell adapted to receive a deceased, a casket lid closeable on said shell, a first handling bar non-pivotally attached to a side wall of said shell and a second handling bar non-pivotally attached to an end wall of said shell, and a decorative cover overlying adjacent ends of said first and second handling bars, said decorative cover being slotted on opposite lateral sides thereof from an inward edge outwardly such that an upper portion of said decorative cover is positioned above and inward of said ends of said handling bars and a lower portion of said decorative cover is positioned below and inward of said ends of said handling bars, a support mounted to said shell for supporting said adjacent ends of said handling bars, and an attachment mechanism having a first portion mounted to one of said shell and said support and a cooperating second portion mounted to said decorative cover for attaching said decorative cover to said casket shell, wherein said support comprises a right angle rail having a pair of legs with an outwardly extending C-shaped bracket on each said leg, said rail mounted to said casket shell, each said C-shaped bracket slidingly accepting a respective end of a respective one of said handling bars, each said handling bar having a cross-section that generally mates with said C-shaped bracket such that said handling bars do not rotate in said brackets.

24. A casket comprising:

a casket shell adapted to receive a deceased, a casket lid closeable on said shell, a first handling bar non-pivotally attached to a side wall of said shell and a second handling bar non-pivotally attached to an end wall of said shell, and a decorative cover overlying adjacent ends of said first and second handling bars, said decorative cover being slotted on opposite lateral sides thereof from an inward edge outwardly such that an upper portion of said decorative cover is positioned above and inward of said ends of said handling bars and a lower portion of said decorative cover is positioned below and inward of said ends of said handling bars, a support mounted to said shell for supporting said adjacent ends of said handling bars, and an attachment mechanism having a first portion mounted to one of said shell and said support and a cooperating second portion mounted to said decorative cover for attaching said decorative cover to said casket shell, wherein said first and second portions of said attachment mechanism resiliently cooperate to attach said decorative cover to said casket shell.

25. A casket comprising:

a casket shell adapted to receive a deceased, a casket lid closeable on said shell, a first handling bar non-pivotally attached to a side wall of said shell and a second handling bar non-pivotally attached to an end wall of said shell, and a decorative cover overlying adjacent ends of said first and second handling bars, said decorative cover being slotted on opposite lateral sides thereof from an inward edge outwardly such that an upper portion of said decorative cover is positioned above and inward of said ends of said handling bars and a lower portion of said decorative cover is positioned below and inward of said ends of said handling bars, a support mounted to said shell for supporting said adjacent ends of said handling bars, and an attachment mechanism having a first portion mounted to one of said shell and said support and a cooperating second portion mounted to said decorative cover for attaching said decorative cover to said casket shell, wherein said attachment mechanism first portion comprises:

a pair of legs, a pair of generally vertically oriented side walls each of which is associated with a respective one of said legs, each said side wall including a generally vertically oriented rib thereon, wherein said attachment mechanism second portion comprises:

a pair of generally vertically oriented side walls each of which includes a generally vertically oriented slot therein;

said pair of attachment mechanism second portion side walls resiliently cooperating with said pair of attachment mechanism first portion side walls such that said ribs are received in said slots.

26. The casket of claim 25 wherein said attachment mechanism first portion includes a pair of vertically spaced apart vertical locators preventing vertical movement of said attachment mechanism second portion beyond a predetermined amount.

27. The casket of claim 26 wherein each said side wall of said attachment mechanism first portion includes said pair of vertically spaced apart vertical locators.

28. The casket of claim 27 wherein each of an upper edge and a lower edge of each said side wall of said attachment mechanism second portion includes a notch therein receiving a respective one of said vertically spaced apart vertical locators.

29. The casket of claim 25 wherein said attachment mechanism first portion includes at least one horizontal locator horizontally spaced apart from one of said side walls of attachment mechanism first portion, said at least one horizontal locator and said one side wall preventing horizontal movement of said attachment mechanism second portion beyond a predetermined amount.

30. The casket of claim 29 wherein each said side wall of said attachment mechanism first portion includes a pair of vertically spaced apart horizontal locators.

31. The casket of claim 25 wherein said side walls of said attachment mechanism first portion are connected with a front wall.

32. The casket of claim 25 wherein said side walls of said attachment mechanism second portion are cantilevered from a front wall of said decorative cover, and wherein each of said side walls of said attachment mechanism second portion are further connected to said front wall of said decorative cover with a pair of vertically spaced apart gussets.

33. The casket of claim 32 wherein an upper gusset of each said pair of gussets is positioned above an upper end of a respective one of said generally vertically oriented slots and a lower gusset of each said pair of gussets is positioned below a lower end of a respective one of said generally vertically oriented slots.

34. The casket of claim 25 wherein said first and second portions of said attachment mechanism are molded from plastic.

35. The casket of claim 34 wherein said decorative cover and said attachment mechanism second portion are integrally molded from plastic.

36. The casket of claim 25 wherein said legs of said attachment mechanism first portion are fastened to said casket shell wall with plastic Christmas tree fasteners.

37. A casket comprising:

a casket shell adapted to receive a deceased, a casket lid closeable on said shell, a handling bar non-pivotally attached to said shell, and a decorative cover overlying said handling bar, said decorative cover being slotted on opposite lateral sides thereof from an inward edge outwardly such that an upper portion of said decorative cover is positioned above and inward of said handling bar and a lower portion of said decorative cover is positioned below and inward of said handling bar, one of said casket shell and decorative cover having a pair of ribs and the other of said casket shell and decorative cover having a pair of slots, each said rib being resiliently received in a respective one of said slots.

38. The casket of claim 37 further comprising:

a support mounted to said shell for supporting said handling bar.

39. The casket of claim 37 wherein said casket is fabricated of wood.

40. The casket of claim 37 wherein said casket is fabricated of sheet metal.

41. The casket of claim 37 wherein said decorative cover is selected from a group consisting of shell side wall decorative covers, shell end wall decorative covers, and shell corner decorative covers.

42. A casket comprising:

a casket shell adapted to receive a deceased, a casket lid closeable on said shell, a handling bar non-pivotally attached to said shell, and a decorative cover overlying said handling bar, said decorative cover being slotted on opposite lateral sides thereof from an inward edge outwardly such that an upper portion of said decorative cover is positioned above and inward of said handling bar and a lower portion of said decorative cover is positioned below and inward of said handling bar, a support mounted to said shell for supporting said handling bar, and an attachment mechanism having a first portion mounted to one of said shell and said support and a cooperating second portion mounted to said decorative cover for attaching said decorative cover to said casket shell, wherein said first and second portions of said attachment mechanism resiliently cooperate to attach said decorative cover to said casket shell.

43. The casket of claim 42, wherein said attachment mechanism first portion comprises:

a pair of legs, a pair of generally vertically oriented side walls each of which is associated with a respective one of said legs, each said side wall including a generally vertically oriented rib thereon, wherein said attachment mechanism second portion comprises:

a pair of generally vertically oriented side walls each of which includes a generally vertically oriented slot therein;

said pair of attachment mechanism second portion side walls resiliently cooperating with said pair of attachment mechanism first portion side walls such that said ribs are received in said slots.

44. The casket of claim 43 wherein said attachment mechanism first portion includes a pair of vertically spaced apart vertical locators preventing vertical movement of said attachment mechanism second portion beyond a predetermined amount.

45. The casket of claim 44 wherein each said side wall of said attachment mechanism first portion includes said pair of vertically spaced apart vertical locators.

46. The casket of claim 45 wherein each of an upper edge and a lower edge of each said side wall of said attachment mechanism second portion includes a notch therein receiving a respective one of said vertically spaced apart vertical locators.

47. The casket of claim 43 wherein said attachment mechanism first portion includes at least one horizontal locator horizontally spaced apart from one of said side walls of attachment mechanism first portion, said at least one horizontal locator and said one side wall preventing horizontal movement of said attachment mechanism second portion beyond a predetermined amount.

48. The casket of claim 47 wherein each said side wall of said attachment mechanism first portion includes a pair of vertically spaced apart horizontal locators.

49. The casket of claim 43 wherein said side walls of said attachment mechanism first portion are connected with a front wall.

50. The casket of claim 43 wherein said side walls of said attachment mechanism second portion are cantilevered from a front wall of said decorative cover, and wherein each of said side walls of said attachment mechanism second portion are further connected to said front wall of said decorative cover with a pair of vertically spaced apart gussets.

51. The casket of claim 50 wherein an upper gusset of each said pair of gussets is positioned above an upper end of a respective one of said generally vertically oriented slots and a lower gusset of each said pair of gussets is positioned below a lower end of a respective one of said generally vertically oriented slots.

52. The casket of claim 43 wherein said first and second portions of said attachment mechanism are molded from plastic.

53. The casket of claim 52 wherein said decorative cover and said attachment mechanism second portion are integrally molded from plastic.

54. The casket of claim 43 wherein said legs of said attachment mechanism first portion are fastened to said casket shell wall with plastic Christmas tree fasteners.

* * * * *